US006942011B2

(12) United States Patent
Anton et al.

(10) Patent No.: US 6,942,011 B2
(45) Date of Patent: Sep. 13, 2005

(54) ADJUSTABLE MOLD DIVIDER FOR FITTING IN A CONVENTIONAL INGOT MOLD

(75) Inventors: Ottmar Anton, Köln (DE); Karl Otto Liebisch, Duisburg-Rheinhausen (DE); Heinz-Peter Kaiser, Neukirchen-Vluyn (DE); Michael Dreis, Duisburg (DE); Edmund Becker, Schwerte (DE); Alfons Krausa, Schermbeck (DE); Horst von Wyl, Duisburg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/473,437

(22) PCT Filed: Mar. 20, 2002

(86) PCT No.: PCT/EP02/03052

§ 371 (c)(1),
(2), (4) Date: Apr. 1, 2004

(87) PCT Pub. No.: WO02/078879

PCT Pub. Date: Oct. 10, 2002

(65) Prior Publication Data

US 2004/0154782 A1 Aug. 12, 2004

(30) Foreign Application Priority Data

Mar. 30, 2001 (DE) ..... 101 16 087

(51) Int. Cl.[7] ..... B22D 11/00

(52) U.S. Cl. ..... 164/418; 164/420; 164/436

(58) Field of Search ..... 164/418, 420, 164/436, 491

(56) References Cited

U.S. PATENT DOCUMENTS

| | | | | |
|---|---|---|---|---|
| 3,292,216 A | | 12/1966 | Colombo | |
| 3,717,197 A | * | 2/1973 | Strack et al. | 164/420 |
| 4,566,523 A | * | 1/1986 | Vaubel | 164/420 |
| 4,637,452 A | | 1/1987 | Kawakami | |
| 4,942,919 A | | 7/1990 | Poran et al. | |
| 6,408,930 B1 | * | 6/2002 | von Wyl et al. | 164/436 |

FOREIGN PATENT DOCUMENTS

| | | |
|---|---|---|
| DE | 1059626 | 6/1959 |
| GB | 1308592 | 2/1973 |

* cited by examiner

*Primary Examiner*—Kevin Kerns
*Assistant Examiner*—I.-H. Lin
(74) *Attorney, Agent, or Firm*—Abelman, Frayne & Schwab

(57) ABSTRACT

The invention relates to a mold divider for fitting in a conventional slab mold (1) having laterally adjustable narrow-side parts for selective casting of several strands with changeable strand widths. The mold divider consists of a housing (3) fixedly securable relative to the mold (1), between the broad-side plates (2) and having bilaterally adjustable, in a broad-side direction of the mold (1), adjusting organs (4), with supporting plates (5) provided at their ends and with the narrow-side heat-exchanger plates (6) arranged thereon.

10 Claims, 6 Drawing Sheets

ADJUSTABLE MOLD DIVIDER FOR FITTING IN A CONVENTIONAL INGOT MOLD

CROSS-REFERENCE TO RELATED APPLICATION

This application is a 371 of PCT/EP02/03052 filed on Mar. 30, 2002.

BACKGROUND OF THE INVENTION

1. Field of the Invention

The invention relates to an adjustable mold divider for fitting in a conventional slab mold with laterally adjustable narrow-side parts for selective casting of several strands with changeable strand widths.

2. Description of the Prior Art

Continuous casting molds for steel, as a rule, have adjustable narrow sides, which are adjusted during casting or during interruptions of casting and the adjustment regions of which are limited by mechanical conditions such as, e.g., regulation range of the drives or spatial limits, and acting forces, on one hand and, on the other hand, by requirements of the process, e.g., interrelationship between time from tap to tap, pouring rate, and pouring width.

When a desired pouring width spectrum of such mold cannot be economically encompassed by widening of the adjustment region of a separate slab strand, a mold divider, which is also called a Twin-Divider, is used. With it, a separate strand is divided in two strand sections. In this way, strands having half of a width can be produced, without the reduction of the pouring output.

A mold divider is usually produced with a fixed geometry corresponding to the distance between the mold plates and to their conicity. When the mold divider should be adapted to very different size ranges, it is made completely replaceable or with insertable adaptation or adjusting pieces. Such adaptation can only be effected outside of the casting process and, therefore, the costs are substantially increased due to idle periods of the plant. In addition, the formation of the narrow side conicity on the mold divider and the positioning of a submerged nozzle can be effected only for medium pouring widths. Both limitations result from the increase of the strand shell tension and worsening of a flow pattern in the liquid content of a strand, leading to negative metallurgical consequences.

The object of the invention is to provide an adjustable mold divider in which the above-mentioned drawbacks are eliminated.

SUMMARY OF THE INVENTION

With a mold divider according to the preamble of claim 1, the object of the invention is achieved by arranging, between the broad sides of a conventional ingot mold, of an adjusting organ for adjusting during the casting process and which consists essentially of a housing or a base body that remains stationary relative to the mold during casting. The housing includes bilaterally adjustable, in a broad-side direction of the mold, adjusting organs with supporting plates provided at their ends for supporting heat-exchanger plates. Advantageously the adjusting organs consist of spindles which are driven via gear means integrated in the housing and drive shafts by outwardly located motors, enabling an adjustment during casting or during interruption of casting.

The motors can be driven electrically, pneumatically or hydraulically. An adjustment with a muscle force is also contemplated. As a variation of the invention, the use of hydraulic or electrical linear drives as spindle drives is possible.

For absorption of vertical forces of the own weight, strand pull, and oscillations, sleeve tubes can be used, which surround the adjusting spindles and are connected with the housing by linear guides.

For an optimal use of the available mounting space and obtaining of the largest possible adjustment path, and for removal of vertical loads, it is proposed to provide the upper edges of the supporting plates with transverse bolts which would slidably engage in grooves formed in upper regions of the broad-side heat-exchanger plates.

A further increase of the adjustment path at a given mounting space is possible by using telescopic spindles.

The most possible flexibility during adjustment of the pouring width during a casting process is achieved by driving all four drive axles independently from each other by their own drive chains and motors. This embodiment requires, however, the largest mounting space. Therefore, with making allowance for a reduced flexibility of the motion process, e.g., both, arranged one above the other, spindles of each side, can be driven by a common motor and be mechanically connected by a suitable staggered different gear stages in such a way that the necessary for the casting process inclination, the so-called contraction conicity of the heat-exchanger plates is maintained, dependent on the adjustment path.

The staggered stages can also be achieved by different spindle inclinations. Further, making allowance for a reduced flexibility of the to-be-cast size spectrum, the two axes, which are arranged at the same height, of respective opposite voids are mechanically coordinated. This can be effected with one continuous spindle that displaces both supporting plates in the same direction. The arrangement insures that the pouring output of an entire mold remains constant. Thus, while a casting size is increased on one side, it is correspondingly reduced on the opposite side. However, an embodiment is contemplated in which both sides are displaced in opposite direction but by the same amount.

For a special operational case at which in the same mold a wide slab and also two twin slabs are cast, the housing is arranged between non-changeable broad-side heat-exchanger plate. This, however, requires an increased mounting space and an elongate adjustment path. In addition, it is necessary to route the drive chain or, when linear drives are used, their power supply line over the broad-side water boxes or beneath them. Upon relinquishing of the double use of the same mold for single and twin casting, the broad-side heat-exchanger plate can be recessed in the region of the mold parts. This provides, on one hand, space for the adjusting mechanism and opens, on the other hand, a possibility of routing the drive chain through the water box. Also a valuable space is obtained for delivering of media. Further, level changes do not adversely affect the divided streams.

The adjustable mold divider can be arranged off-center between the broad-side plates of a mold. Thereby, the range of simultaneously cast sizes can be increased at the same mounting space, even when reserved parts for each separate strand are retained.

A further practical measure for widening of the adjustment path consists in recessing of the supporting plates up to the heat-exchanger plates for increasing the length of the spindle. It is advantageous, in this case, to form the recess by deep hole boring in order to avoid sealing problems.

Finally, care should be taken that the position and, in particular, the amount of inclination of narrow sides of the mold, in view of the reliability of the casting process, is adjusted within very narrow limits. In may cases, even the use of backlash-reducing drive components is not sufficient for retaining the required tolerances. Also, with an increase of a required precision, the production costs disproportionally increase. In view of the above, different alternatives are proposed for compensation of a backlash in an available mold divider. One possibility consists in use of an adjustable split nut. In molds with a sufficient mounting height, in one or both axes, preferably at the middle, between the adjusting spindles, linear, under tension-working drive elements, such as hydraulic or pneumatic cylinders, can be arranged. The traction or tension means has to be so lay-out that it applies, either during the entire operational time or during the adjusting process, a tensioning force to the narrow-side supports which is large enough to constantly bring all of the plays in the adjusting drive chain to the pressure side. Instead of linear drives, rope drives, which are actuated from outside, can be used.

It is also possible to minimize the mounting space necessary for backlash compensation in the region of the adjusting gear unit. When the available mounting space is not sufficient for this type of backlash compensation, it is proposed to compensate the backlash in the drive chain in such a way that in the last adjusting step, the adjustment always takes place against forces which are expected during the operation, independent of the adjustment direction required by the operation. The size of the return path should only be larger that the largest allowable total backlash in the drive chain. This solution, at the same time, is associated with the lowest costs of modification of the mold divider.

With the described mold divider, twin strands in a large spectrum with variable pouring widths can be cast, without interruption of the operation and with an optimal flow of liquid with a symmetrical flow-in of melt.

Thereby, the economical advantages, together with achieved, according to the present invention, expansion of slab casters, permit to achieve metallurgically sensible steel qualities.

The present invention, which is designed for use in the region of conventional twin-casting, permits to substantially reduce the take-down time. In addition, the use of different mold dividers with different widths for adaptation to a changeable size spectrum and, thereby, an increased capacity of spare part storage become unnecessary.

In addition, in molds with a mold divider, there exists a possibility of reducing the length of transition wedges by using adjustment strategies with a continuously changeable small-side inclination during the adjustment process. Altogether, with a simultaneous reduction of scrap, the system availability and, thereby, rentability of continuous casters is increased.

BRIEF DESCRIPTION OF THE DRAWINGS

Further particularities, features, and advantages of the invention follow from the description of the embodiment shown in the drawings. The drawings show.

DETAILED DESCRIPTION OF THE PREFERRED EMBODIMENT

Figure 1:
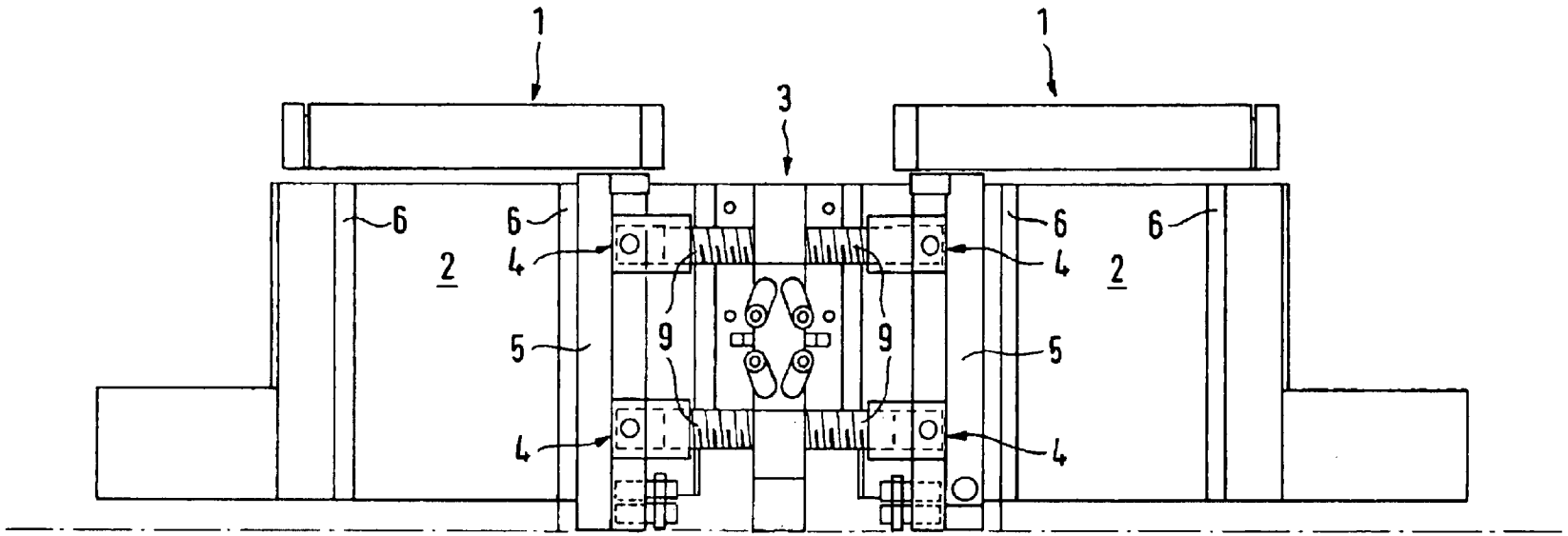
FIG. 1 a side view of an adjustable mold divider (Conti-Twin Divider with mechanical adjusting organs as viewed along line A—A in FIG. 2.
Figure 2:
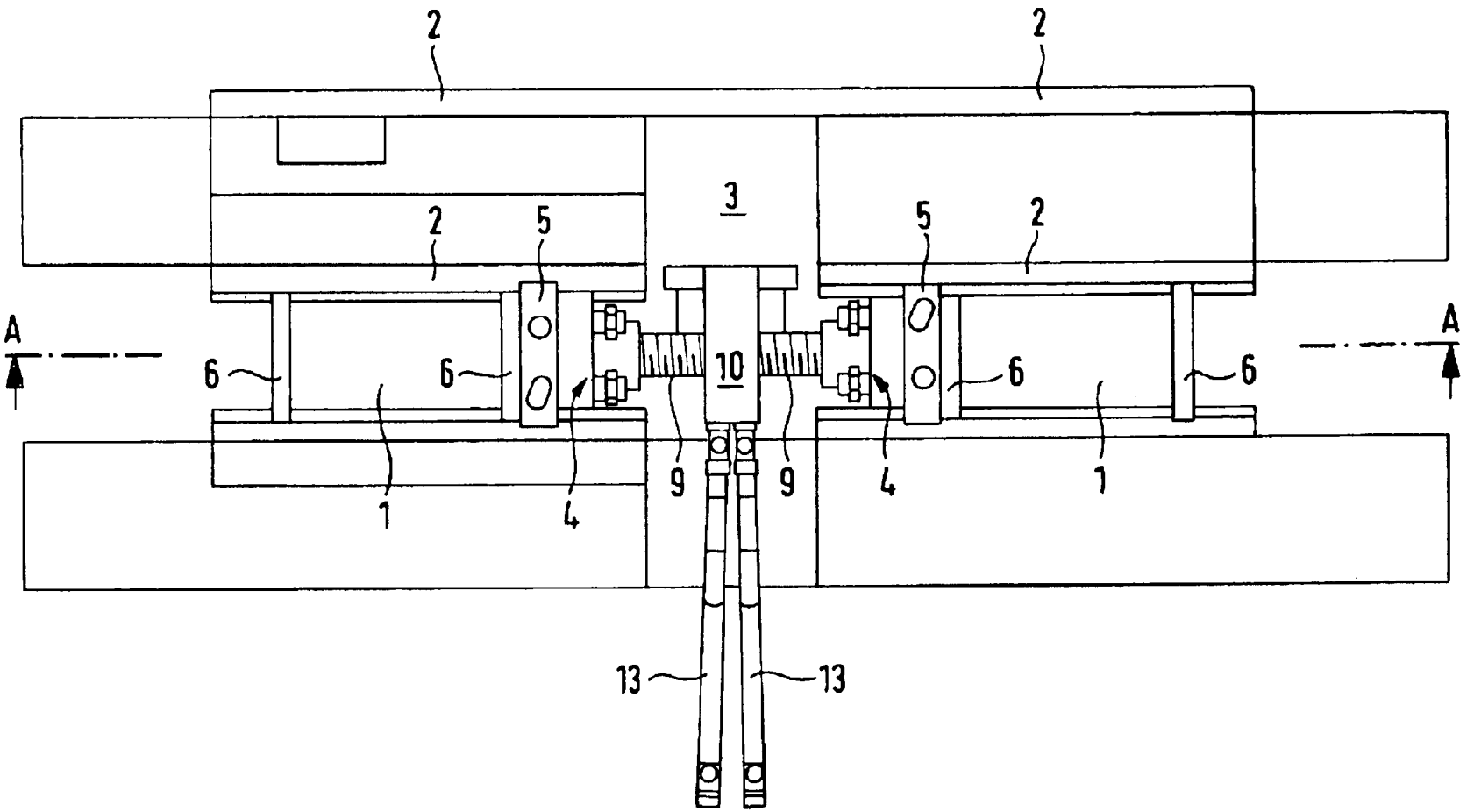
FIG. 2 a plan view of the mold divider shown in FIG. 1.

FIG. 1 shows an adjustable mold divider for fitting in a conventional slab mold 1 with a narrow-side plates 6 laterally adjustable during a casting process. The mold divider has a housing 3 which is fixedly secured with respect to the mold 1 between its broad-side plates 2 and which has adjustable organs 4 arranged paarwise one above the other in the width direction of the mold 1 on opposite sides of the housing 3, with supporting plates 5 provided at their ends and with narrow-side heat-exchanger plates 6 arranged thereon.

Figure 4:
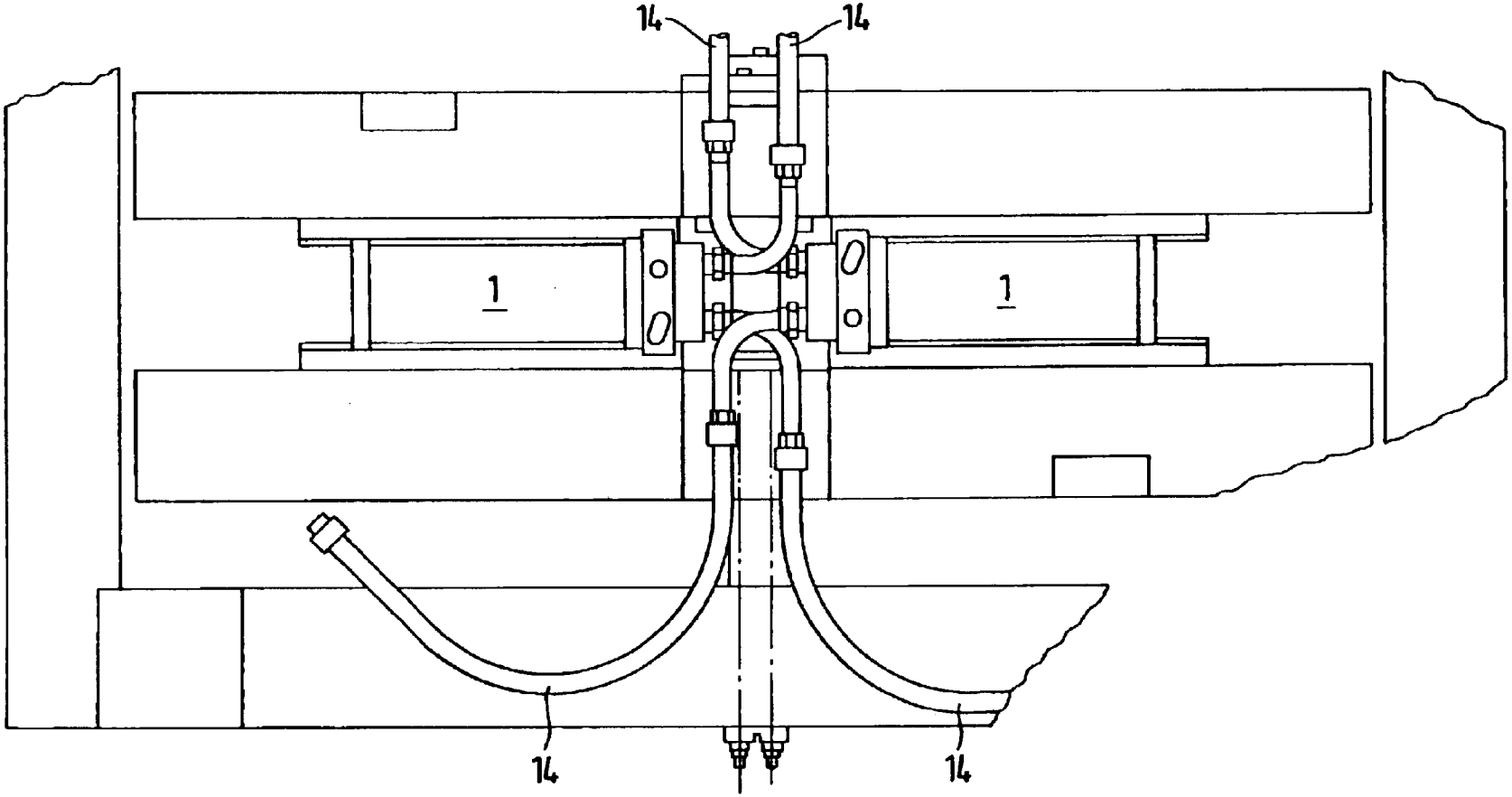
FIG. 4 a plan view of the mold divider shown in FIG. 3.
Figure 5:
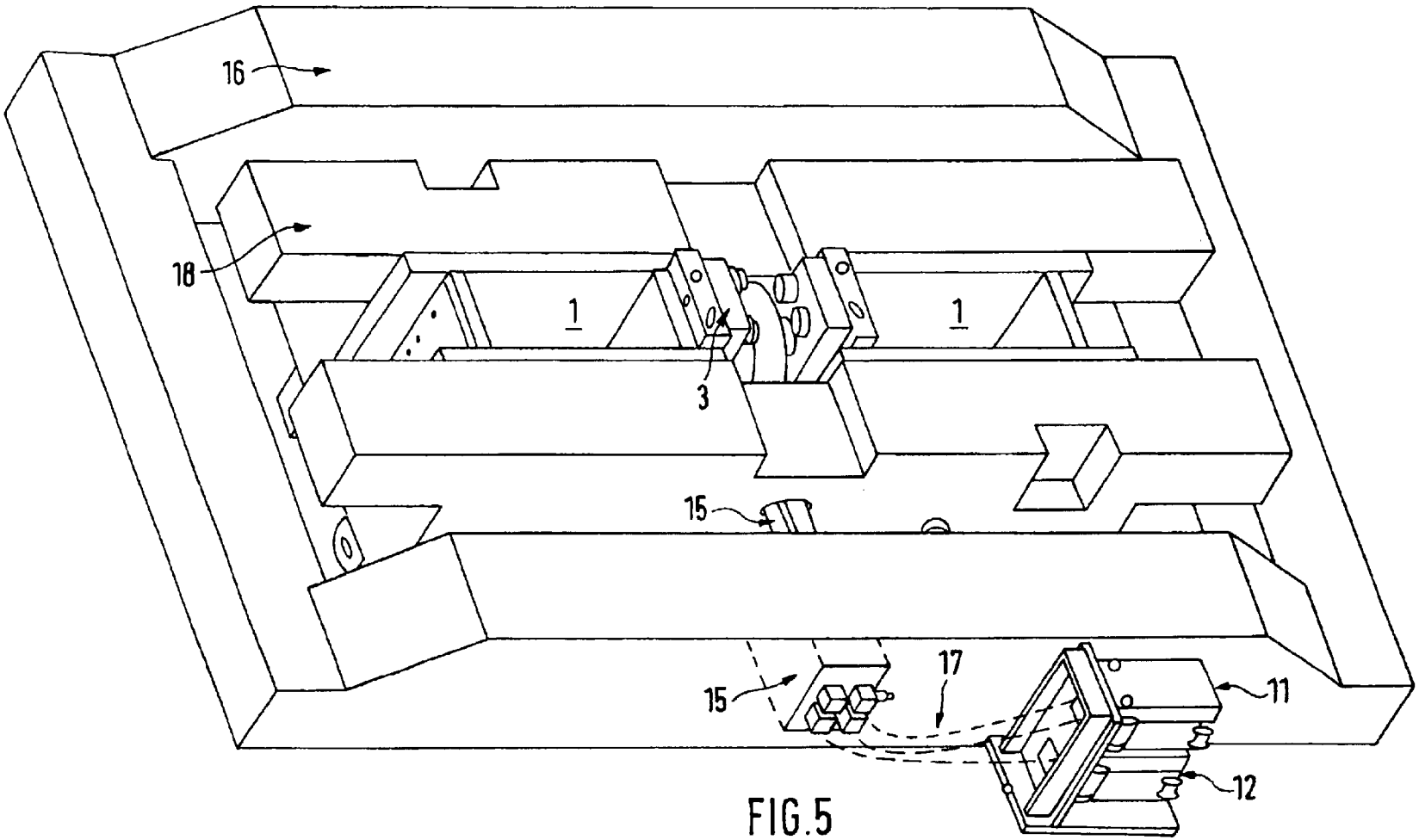
FIG. 5 a perspective view of a continuous casting mold with a housing of an adjustable mold divider installed in the middle region of the mold.

The adjusting organs 4 of the mold divider advantageously are formed as spindles 9 which are driven by means 10, which is integrated in the housing 3, via a gear mechanism and shafts 13 driven by outwardly located motors 11, 12, shown in FIGS. 4 or 5, electrically, hydraulically or pneumatically.

Figure 3:
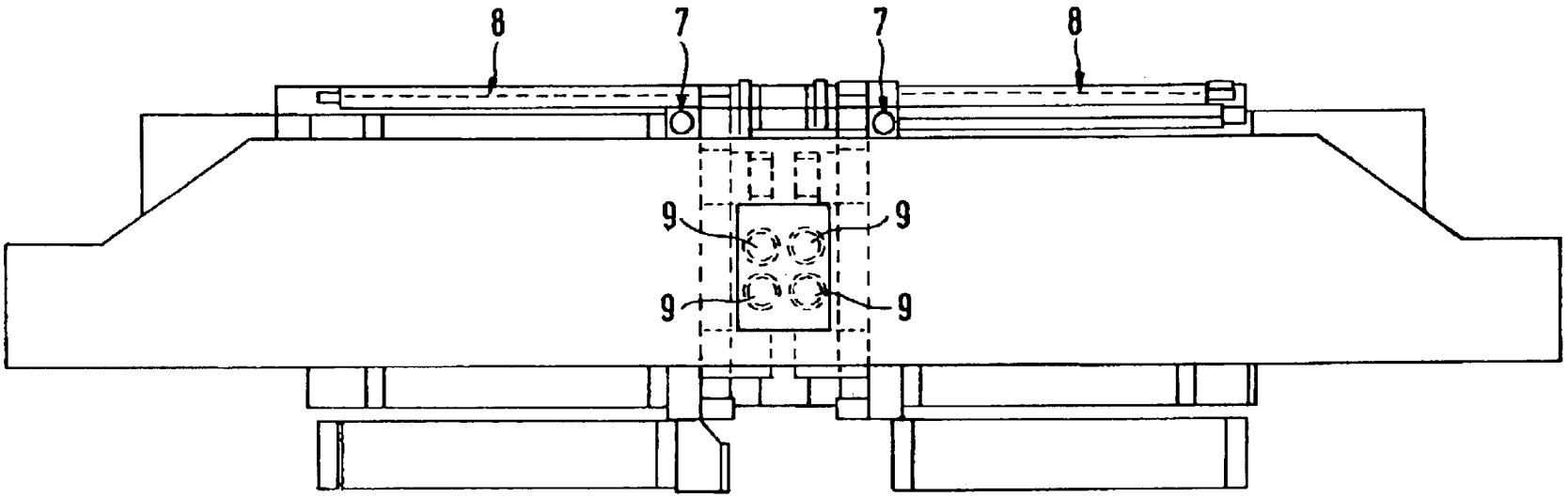
FIG. 3 a side view of a mold with a mold divider with hydraulic or pneumatic drives.
Figure 6:
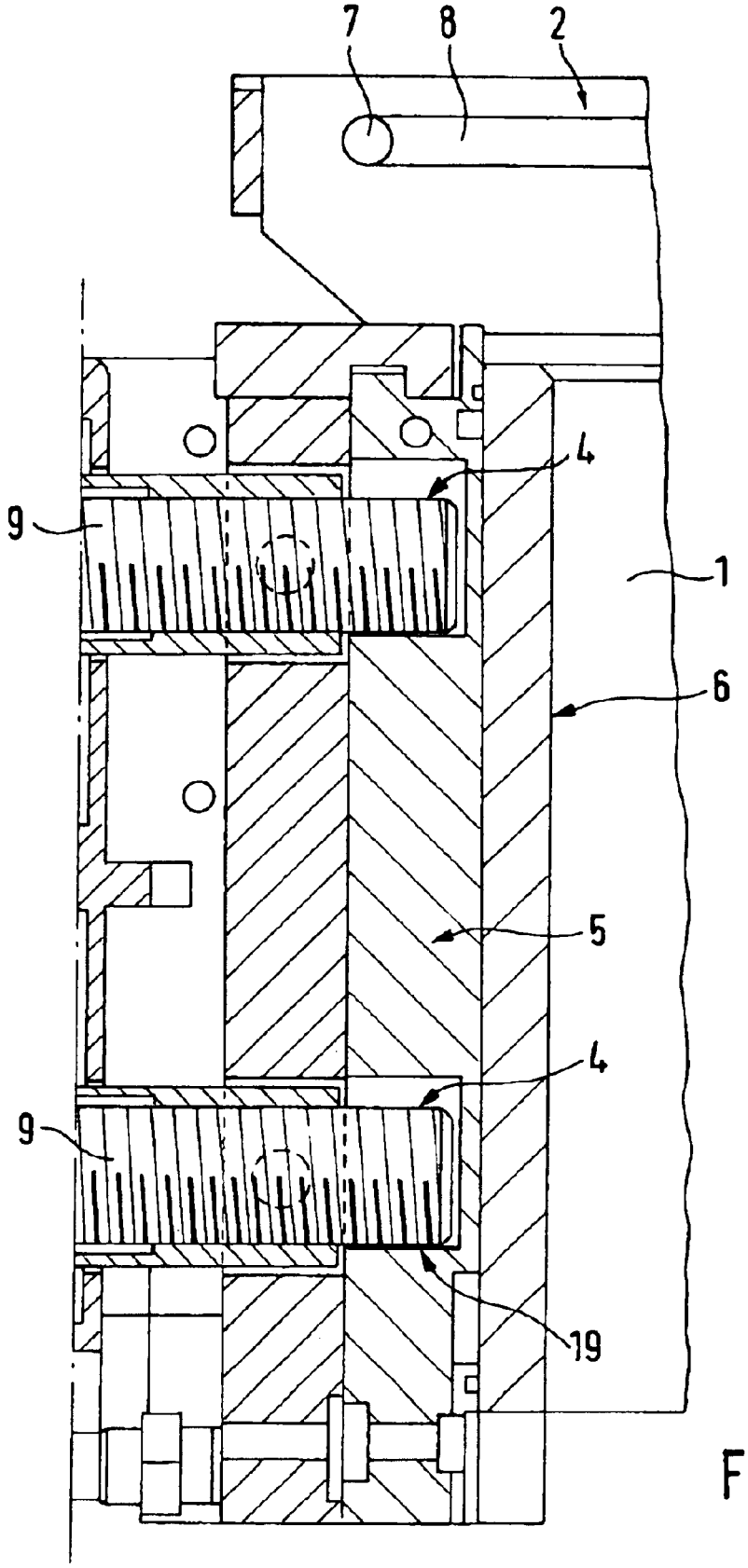
FIG. 6 a cross-sectional view of a spindle drive for adjusting the mold divider.

For supporting vertical loads or forces, the supporting plates 5 are provided in the upper region, as shown in FIGS. 3 and 6, with transverse guide bolts 7 engageable in guide grooves 8 formed in the upper region of the mold broad-side plates 2.

The reference numerals 9 designate spindles which are discernible from the cross-sectional view of FIG. 3.

FIG. 4 shows oil feed means 14 for hydraulic oil and provided for a hydraulic drive of the spindles, the connections of which for spindle drives 9 are shown in FIG. 3.

In the perspective view of FIG. 5, the dash lines 17 show a drive connection between the outwardly located motors 11, 12 and a drive chain 15 extendable through the mold frame 16 and a water box 18.

FIG. 6 shows, in a cross-sectional view transverse to the supporting plate 5 and the arranged thereon, heat-exchanger plate 6, that for widening an adjustment path of the spindles 9, the supporting plates 5 are recessed up to the heat-exchanger plates 6, with the recess being formed by deep hole boring to avoid sealing problems.

Reference Numerals

1. Mold
2. Elongate side plate
3. Housing
4. Adjusting organ
5. Supporting plate
6. Heat-exchanger plate
7. Guide bolt
8. Guide groove
9. Spindle
10. Drive means
11. Outwardly located motor
12. Outwardly located motor
13. Drive shaft
14. Oil-feeding hydraulic
15. Extension of the drive chain
16. Mold frame
17. Drive transmission
18. Water box
19. Deep hole boring

What is claimed is:

1. A mold divider for fitting into a conventional slab mold (1) having laterally adjustable narrow-side parts for selective casting of several strands widths, comprising a housing (3) fixedly securable, relative to the mold (1), between its broad-side plates (2) and having bilaterally adjustable in a broad-side direction of the mold (1), adjusting organs (4) with supporting plates (5) provided at their ends and with arranged thereon, narrow-side heat-exchanger plates (6)

characterized in that the adjusting organs (4) are driven by drive means (10) integrated in the housing (3) via gear means and shafts (13) by outwardly located motors (11, 12), and enable adjustment during casting or during interruption of casting, and in that all of the adjusting organs (4) of a supporting plate (5) are equipped with separate drive means independently of one another.

2. A mold divider according to claim 1, characterized in that for receiving vertical loads or forces, the supporting plates (5) have, in an upper region thereof, transversely extending guide bolts (7) engageably displaceable in guide grooves (8) formed in an upper region of the mold broad-side plates (2).

3. A mold divider according to claim 1, characterized in that pairwise, arranged one above another spindles (9) of one side of the housing (3) are driven by a common motor (11 or 12) and are, e.g., so connected by staggered different gear stages that an appropriate contraction concinnity of the narrow-side heat-exchanger plates (6) is achieved in accordance with a dimension of its adjustment path.

4. A mold divider according to claim 1, characterized in that with an off-center fitting of the housing (3) between the broad-side plates (2), the region of simultaneously casted strand sizes is increased at a predetermined mounting space and an asymmetrical construction of the mold (1).

5. A mold divider according to claim 1, characterized in that the supporting plate (5) of one or both housing sides is recessed up to the heat-exchanger plate (6) for lengthening of the adjusting organs, wherein the recesses, advantageously, are formed by deep hole boring (19).

6. A mold divider according to claim 1, characterized in that the housing (3), together with the adjusting organs (4) is arranged in a center or off-center between the broad-side plates (2) of the mold (1).

7. A mold divider according to claim 1, characterized in that for compensation of a mechanical play of the adjustment path, the adjusting organs (4) are associated with acting in opposite direction, force elements or the spindle (9) is equipped with an adjustable split nut.

8. A mold divider according to claim 1, characterized by a telescopic formation of the spindles (9).

9. A mold divider according to claim 1, characterized by a stepped formation of the spindles (9).

10. A mold divider according to claim 1, characterized by a continuous spindle (9) for both supporting plates (5).

* * * * *

UNITED STATES PATENT AND TRADEMARK OFFICE

CERTIFICATE OF CORRECTION

PATENT NO. : 6,942,011 B2
APPLICATION NO. : 10/473437
DATED : September 13, 2005
INVENTOR(S) : Ottmar Anton et al.

It is certified that error appears in the above-identified patent and that said Letters Patent is hereby corrected as shown below:

On the Title Page change field (73) to read:

{73} Assignee: SMS Demag Aktiengesellschaft, Duesseldorf (DE)

Signed and Sealed this

Twenty-fourth Day of April, 2007

JON W. DUDAS
*Director of the United States Patent and Trademark Office*